US006355898B1

(12) United States Patent
Gimeno et al.

(10) Patent No.: US 6,355,898 B1
(45) Date of Patent: Mar. 12, 2002

(54) FAST CONTROL DEVICE FOR HIGH-VOLTAGE SWITCHGEAR, IN PARTICULAR FOR A GROUNDING DISCONNECTOR

(75) Inventors: Carmelo Gimeno, Aarau; Max Hauri, Kirchleerau, both of (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/577,599

(22) Filed: May 25, 2000

(30) Foreign Application Priority Data

May 28, 1999 (FR) ..... 99 07114

(51) Int. Cl.[7] ..... H01H 3/00; H01H 3/24

(52) U.S. Cl. ..... 218/154; 200/400

(58) Field of Search ..... 335/117–172; 200/400–401; 218/154, 120, 122, 140

(56) References Cited

U.S. PATENT DOCUMENTS

| | | | | |
|---|---|---|---|---|
| 4,821,008 A | * | 4/1989 | Micoud et al. | 335/189 |
| 4,915,354 A | * | 4/1990 | Sims, Jr. et al. | 251/334 |
| 4,996,397 A | * | 2/1991 | Kuhn et al. | 218/154 |

FOREIGN PATENT DOCUMENTS

| | | |
|---|---|---|
| DE | 26 03 536 A1 | 8/1977 |
| DE | 36 08 934 A1 | 9/1987 |
| DE | 44 46 664 C1 | 3/1996 |
| EP | 0 558 115 A1 | 9/1993 |
| FR | 2 766 961 A1 | 2/1999 |
| GB | 1 578 740 | 11/1980 |

* cited by examiner

*Primary Examiner*—Lincoln Donovan
(74) *Attorney, Agent, or Firm*—Sughrue Mion, PLLC

(57) ABSTRACT

A fast control device for high-voltage switchgear, in particular a grounding disconnector which is equipped with a moving contact, which fast control device comprises a spring for storing mechanical energy, a cocking mechanism for cocking the spring and comprising an electric motor organized to rotate at least one rotary part organized to take up two stable positions corresponding respectively to the spring being cocked and to the spring being not cocked, said cocking mechanism being provided with a connection rod coupled to an actuating mechanism for actuating a moving contact, the connection rod being associated with a brake shock-absorber device. This brake shock-absorber device comprises at least one hydraulic shock-absorber co-operating with the connection rod and secured to the housing of the device via a spring member. By means of this brake shock-absorber device, the control device is effective, reliable, and its cost is particularly advantageous.

6 Claims, 2 Drawing Sheets

FAST CONTROL DEVICE FOR HIGH-VOLTAGE SWITCHGEAR, IN PARTICULAR FOR A GROUNDING DISCONNECTOR

The present invention relates to a fast control device for high-voltage switchgear, in particular a grounding disconnector which is equipped with a moving contact, which fast control device comprises a spring for storing mechanical energy, a cocking mechanism for cocking the spring and comprising an electric motor organized to rotate at least one rotary part organized to take up two stable positions corresponding respectively to the spring being cocked and to the spring being not cocked, said cocking mechanism being provided with a connection rod coupled to an actuating mechanism for actuating a moving contact, the connection rod being associated with a brake shock-absorber device acting as an abutment for said connection rod in the positions that it takes up when said rotary part takes up said two stable positions.

BACKGROUND OF THE INVENTION

A device of that type is known from the French patent application published under the number 2 766 961. In that device, a single shock-absorber, constituted, for example, by an abutment made of rubber, received in a cylindrical bushing, and mounted rigidly in the housing of the device, co-operates with a connection rod coupled to the control mechanism for controlling a moving contact so as to stop the connection rod in its two stable positions and so as to absorb the resulting shocks.

That device is not entirely satisfactory as regards the shock-absorber which is subjected to violent shocks by absorbing suddenly the decelerations of the connection rod.

OBJECTS AND SUMMARY OF THE INVENTION

An object of the present invention is to mitigate the drawbacks of the prior art by providing a device in which the shock-absorbing for the connection rod coupled to the control mechanism for controlling the moving contact takes place effectively and economically satisfactorily.

This object is achieved by a fast control device for high voltage switchgear, wherein the brake shock-absorber device comprises at least one hydraulic shock-absorber mounted on a fixed support secured to the housing of the device having a spring member. This spring member serves to contribute to absorbing the shocks undergone when the connection rod comes into abutment. As a result, the fixing of the shock-absorber proper and the stability of its mounting on its support inside the housing of the device are made safe and reliable.

BRIEF DESCRIPTION OF THE DRAWINGS

The present invention and its advantages are better understood from the following description of a preferred embodiment of the device of the invention given with reference to the accompanying drawings which are given by way of non-limiting example, and in which.

MORE DETAILED DESCRIPTION

Figure 1:
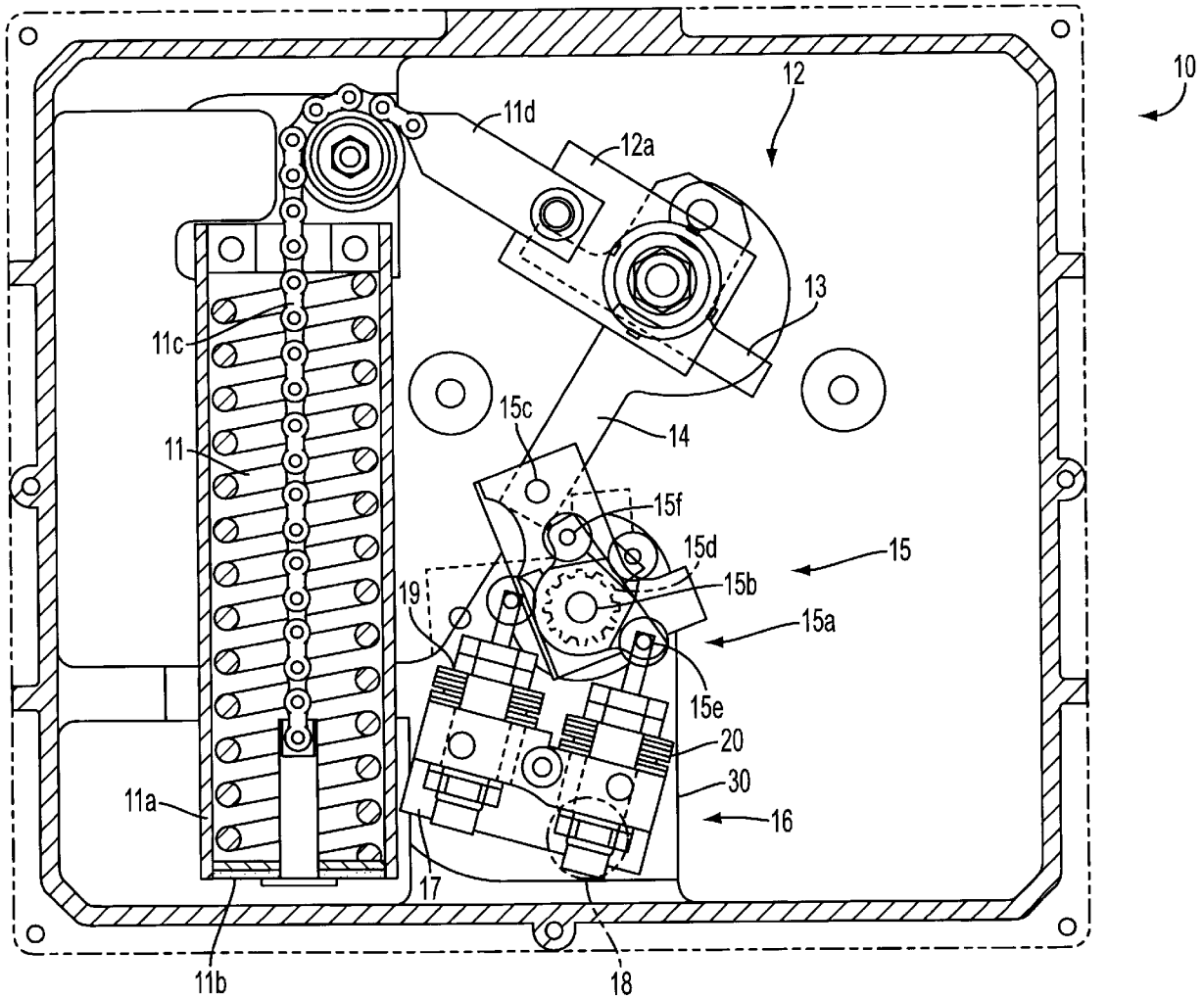
FIG. 1 is a section view showing the main components of the device of the invention.

With reference to the figures, and more particularly with reference to FIG. 1, the fast control device 10 for high-voltage switchgear, and in particular for a grounding disconnector, which is equipped with a moving contact comprises a spring 11 for storing mechanical energy, a cocking mechanism 12 for cocking the spring and comprising an electric motor adapted to take up two stable positions corresponding, respectively, to the spring being cocked and to the spring not being cocked. The cocking mechanism 12 is provided with a connection rod 14 coupled to an actuating mechanism 15 for actuating a moving contact. The connection rod 14 is associated with a brake shock-absorber device 16 acting as an abutment for the connection rod in the positions that it takes up when the rotary part 13 takes up the two stable positions. The brake shock-absorber device 16 comprises at least one hydraulic shock-absorber 17 or 18 mounted on a fixed support secured to the housing 30 of the device having a spring member 19 or 20.

The spring 11 is housed in cylindrical bushing 11A having a moving end wall 11*b* coupled to a chain 11*c* connected via a rod 11*d* to a part 12*a* that is hinged to said rotary part 13. Said spring and all of the associated components are described in detail in the above-mentioned publication illustrating the prior art.

The actuating mechanism 15 associated with the connection rod 14 includes a lever 15*a* which is mounted to pivot about the control pin 15*b* of said moving contact (not shown). The lever is hinged at a point 15*c* to the connection rod 14. In addition, it includes an arm 15*d* secured to the lever or fixed rigidly to the control pin 15*b*, the arm being mounted symmetrically about the pin 15*b* and carrying at its ends two abutment projections 15*e* and 15*f*. The abutment projections 15*e* and 15*f* are organized to co-operate with respective ones of the piston rods of two hydraulic shock-absorbers 17 and 18 of the brake shock-absorber device 16.

Figure 2:
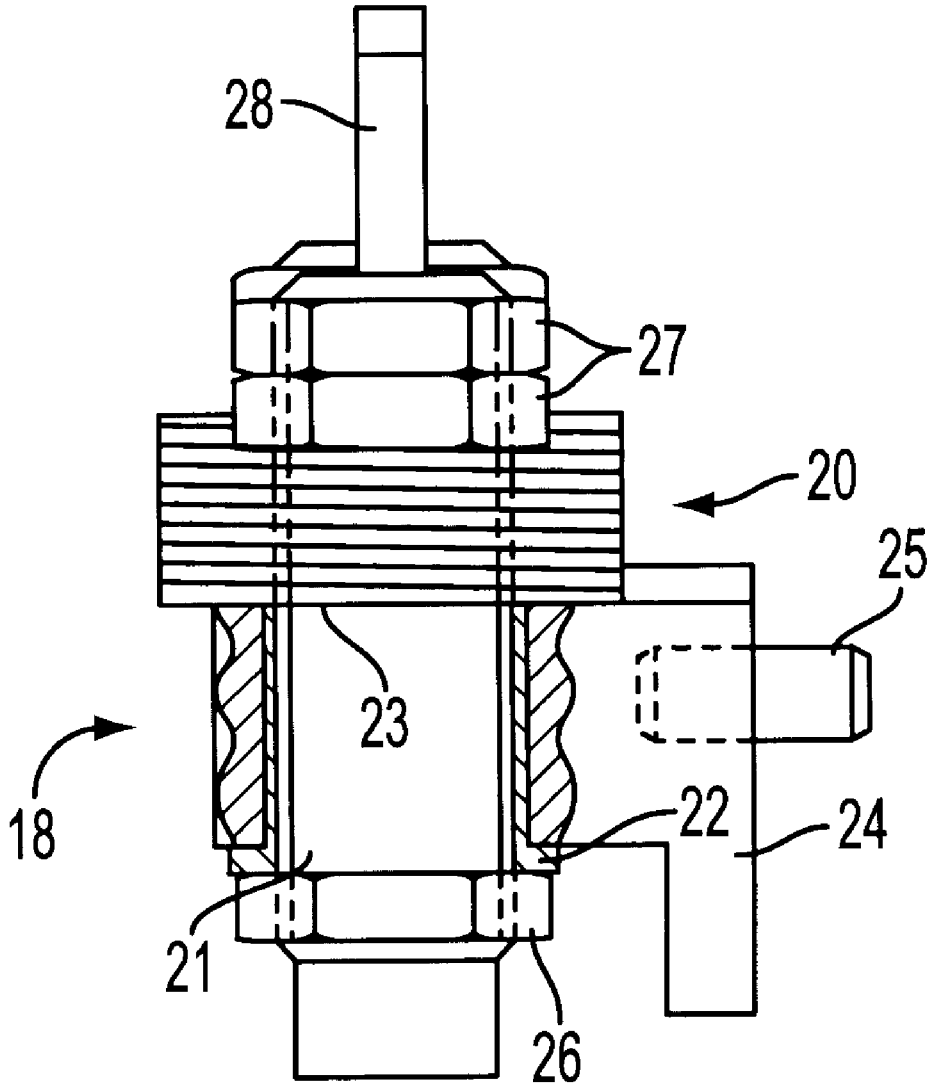
FIG. 2 is an axial section view of a shock-absorber mounted in the device of the invention.

A hydraulic shock-absorber 17 or 18 of the brake shock-absorber device 16 is shown in FIG. 2. It includes a cylindrical threaded body 21 screwed into a cylindrical bushing 22 underlying the spring member 20 which is constituted by a stack of Belleville spring washers. The cylindrical bore 22 is engaged in a bore 23 in a support 24 in the form of a bracket which is secured to the housing of the device by a pin 25 or by any other suitable fixing means. A nut 26 secures the threaded body 21 of the shock-absorber to the cylindrical bushing 22. Two locked-together nuts 27 lock the stack of Belleville spring washers against the bushing 22 and in abutment against the support 24. A piston rod 28 projecting axially from the body of the shock-absorber is organized to co-operate with the projection 15*f*.

By means of this configuration, the shocks due to the projections 15*e* and 15*f* coming suddenly into contact with the piston rods of the hydraulic shock-absorbers 17 and 18 are doubly absorbed, firstly by the Belleville spring washers and secondly by the hydraulic shock-absorbers themselves.

The present invention is not limited to the embodiment described, but rather numerous variants or modifications accessible to the person skilled in the art are possible.

What is claimed is:

1. A fast control device for high-voltage switchgear, in particular a grounding disconnector comprising:

a spring for storing mechanical energy, a cocking mechanism adapted to cock the spring, said cocking mechanism further comprising an electric motor which rotates at least one rotary part to take up two stable positions corresponding respectively to the spring being cocked and to the spring being not cocked, a connection rod extending from said cocking mechanism, an actuating mechanism connected to said connection rod, and a brake shock-absorber device which abuts said actuating mechanism when said rotary part takes up said two stable positions, wherein said brake shock-absorber device further comprises at least one hydraulic shock-absorber mounted on a fixed support secured to a housing of the device, said at least one hydraulic shock-absorber having a spring member which abuts said fixed support.

2. A device according to claim 1, wherein said spring member comprises at least one stack of Belleville spring washers.

3. A device according to claim 1, wherein said brake shock-absorber device comprises two hydraulic shock-absorbers disposed parallel to each other to respectively abut said actuating mechanism when said actuating mechanism takes up its positions corresponding to the two stable positions of the rotary part.

4. A device according to claim 3, wherein said actuating mechanism further comprises a pivotally-mounted lever hinged to said connection rod, the pivotally-mounted lever being secured to a control pin and carrying two abutment projections, and wherein said two hydraulic shock-absorbers further comprise piston rods which respectively abut said two abutment projections of said actuating mechanism.

5. A device according to claim 4, wherein said projections are disposed on an arm secured to the control pin.

6. A device according to claim 5, wherein said arm carrying said projections is mounted with the projections symmetrically disposed about the control pin.

* * * * *